US009941071B1

(12) United States Patent
Chen et al.

(10) Patent No.: US 9,941,071 B1
(45) Date of Patent: Apr. 10, 2018

(54) KEY STRUCTURE

(71) Applicant: Primax Electronics Ltd., Taipei (TW)

(72) Inventors: Bo-An Chen, Taipei (TW); Chien-Hung Liu, Taipei (TW)

(73) Assignee: Primax Elcetronics Ltd., Taipei (TW)

( * ) Notice: Subject to any disclaimer, the term of this patent is extended or adjusted under 35 U.S.C. 154(b) by 0 days.

(21) Appl. No.: 15/596,168

(22) Filed: May 16, 2017

(30) Foreign Application Priority Data

Jan. 20, 2017 (TW) ..... 106102157 A

(51) Int. Cl.
*H01H 13/70* (2006.01)
*H01H 13/14* (2006.01)
*H01H 3/12* (2006.01)

(52) U.S. Cl.
CPC ..... *H01H 13/14* (2013.01); *H01H 3/122* (2013.01)

(58) Field of Classification Search
CPC ..... H01H 3/122; H01H 1/00; H01H 1/12; H01H 1/14; H01H 1/20; H01H 1/58; H01H 1/5805; H01H 3/00; H01H 3/02; H01H 3/12; H01H 3/161; H01H 3/162; H01H 13/00; H01H 13/12; H01H 13/14; H01H 13/50; H01H 13/52; H01H 13/70; H01H 13/78; H01H 13/84; H01H 13/85; H01H 2001/12; H01H 2001/14; H01H 2001/24; H01H 2003/12; H01H 2003/161; H01H 2205/00; H01H 2215/00; H01H 2215/03
USPC ..... 200/344
See application file for complete search history.

(56) References Cited

U.S. PATENT DOCUMENTS 3,922,513 A * 11/1975 Kravchuck ..... H01H 13/12 200/239
5,012,055 A * 4/1991 Matsui ..... H01H 13/50 200/408
5,057,657 A * 10/1991 Skulic ..... H01H 13/705 200/342

* cited by examiner

*Primary Examiner* — Anthony R. Jimenez
(74) *Attorney, Agent, or Firm* — Kirton McConkie; Evan R. Witt

(57) ABSTRACT

A key structure includes a circuit board, a housing, a first metallic element, a second metallic element, a keycap and a conductive strip. The conductive strip is disposed within the housing. The first metallic element and the second metallic element are electrically connected with the circuit board. The housing is disposed on the circuit board. The keycap is fixed on the housing. While the keycap is depressed, a first end of the conductive strip is pressed by the triggering part and the conductive strip is swung relative to the housing. Moreover, a second end of the conductive strip collides with the second metallic element. Consequently, the key structure is triggered. When the second end of the conductive strip collides with the second metallic element, a click sound is generated.

10 Claims, 3 Drawing Sheets

KEY STRUCTURE

FIELD OF THE INVENTION

The present invention relates to a key structure, and more particularly to a mechanical key structure.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay much attention to the development of keyboards.

Hereinafter, a key structure with a scissors-type connecting element in a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11.

The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. The rubbery elastomer 13 is enclosed by the scissors-type connecting element 12. Moreover, the first frame 121 comprises a first keycap post 1211 and a first base plate post 1212. The first frame 121 is connected with the keycap 11 through the first keycap post 1211. The first frame 121 is connected with the base plate 15 through the first base plate post 1212. The second frame 122 is combined with the first frame 121. A first end of the second frame 122 is connected with the base plate 15. A second end of the second frame 122 is connected with the keycap 11. Moreover, the second frame 122 comprises a second keycap post 1221 and a second base plate post 1222. The second frame 122 is connected with the keycap 11 through the second keycap post 1221. The second frame 122 is connected with the base plate 15 through the second base plate post 1222.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

With increasing development of science and technology, a mechanical key structure is introduced into the market. FIG. 2 is a schematic exploded view illustrating a conventional mechanical key structure. As shown in FIG. 2, the mechanical key structure 2 comprises a keycap (not shown), a pedestal 21, an upper cover 22, a push element 23, a linkage element 24, a first spring strip 25, a second spring strip 26 and a circuit board (not shown). The pedestal 21 is covered by the upper cover 22. The upper cover 22 has an opening 221. The linkage element 24 is located at a middle region of the pedestal 21. Moreover, the linkage element 24 is movable upwardly or downwardly relative to the pedestal 21. The first spring strip 25 is partially disposed within the pedestal 21, and located near a sidewall of the pedestal 21. The second spring strip 26 is partially disposed within the pedestal 21, and arranged between the linkage element 24 and the first spring strip 25. The push element 23 and the linkage element 24 are collaboratively disposed on the pedestal 21. The push element 23 is penetrated through the opening 221 and coupled with the keycap. Moreover, the first spring strip 25 and the second spring strip 26 are electrically connected with the circuit board.

Please refer to FIG. 2 again. The linkage element 24 has a protrusion structure 241. The protrusion structure 241 is extended from a sidewall of the linkage element 24 toward the first spring strip 25. Moreover, the first spring strip 25 comprises a fixing part 251 and an elastic part 252. The fixing part 251 is fixed on the pedestal 21. The elastic part 252 is extended from the fixing part 251. Moreover, the elastic part 252 is contacted with the protrusion structure 241 of the linkage element 24. Consequently, the elastic part 252 is movable relative to the fixing part 251.

When the keycap is depressed, the keycap is moved downwardly to push the push element 23. Consequently, the linkage element 24 connected with the push element 23 is moved downwardly. As the linkage element 24 is moved downwardly, the protrusion structure 241 of the linkage element 24 is contacted with the elastic part 252 and moved downwardly along the elastic part 252. While the linkage element 24 is quickly moved in response to the depressing force of the user, the linkage element 24 is quickly moved across the elastic part 252, and the elastic part 252 is pushed by the protrusion structure 241 of the linkage element 24. Consequently, the elastic part 252 is moved relative to the fixing part 251 to collide with the second spring strip 26. Since the first spring strip 25 and the second spring strip 26 are contacted with each other, the circuit board outputs a corresponding key signal. Moreover, while the first spring strip 25 and the second spring strip 26 are contacted with each other, a click sound is generated. Due to the click sound, the user can feel the depressing feedback.

Since the mechanical key structure 2 generates the click sound to provide the feedback feel while the keycap is depressed, the mechanical key structure 2 is favored by many users. However, the conventional mechanical key structure 2 still has some drawbacks. For example, since the push element 23 and the linkage element 24 of the mechanical key structure 2 are coupled with each other, the push element 23 should have a position-limiting structure to limit the movement of the linkage element 24. Under this circumstance, the thicknesses of the push element 23 and the linkage element 24 cannot be effectively reduced. Consequently, the volume of the mechanical key structure 2 cannot be effectively reduced.

Therefore, there is a need of providing a key structure with reduced thickness and enhanced depressing feedback.

SUMMARY OF THE INVENTION

The present invention provides a key structure with reduced thickness and enhanced depressing feedback.

In accordance with an aspect of the present invention, there is provided a key structure. The key structure includes a circuit board, a housing, a first metallic element, a second metallic element, a metallic resilience element, a keycap and a conductive strip. The housing is disposed on the circuit board, and includes a stopping structure. The first metallic element is located at a first side of the housing. The first metallic element is penetrated through a bottom side of the housing and electrically connected with the circuit board. The second metallic element is located at a second side of the housing. A first end of the second metallic element is inserted into an inner portion of the housing. The metallic resilience element is disposed within the housing and connected with the first metallic element. The keycap is disposed over the housing and movable relative to the housing. The keycap includes a triggering part. The triggering part is inserted into the inner portion of the housing and located over the metallic resilience element. The conductive strip is disposed within the housing. A first end of the conductive strip is arranged between the triggering part of the keycap and the metallic resilience element. While the first end of the conductive strip is pressed by the triggering part, the conductive strip is swung relative to the housing and a second end of the conductive strip is moved across the stopping structure to collide with the second metallic element, so that a sound is generated. The second end of the conductive strip has a bent structure close to the stopping structure. An acceleration of the swung conductive strip is increased while the second end of the conductive strip is moved across the stopping structure.

From the above descriptions, the present invention provides the key structure. The circuit board for the key structure is not equipped with the key intersection. That is, the circuit board is not the membrane switch circuit board. Moreover, the first metallic element and the second metallic element are electrically connected with the circuit board. The housing is located over the circuit board. The elastic element is disposed within the housing. Consequently, the keycap is located over the housing. The metallic resilience element is disposed within the housing. When the keycap is depressed, the triggering part of the keycap is moved downwardly to push the first end of the conductive strip. Consequently, the conductive strip is swung relative to the housing, and the second end of the conductive strip collides with the second metallic element. Under this circumstance, the electric connection between the first metallic element and the second metallic element is established. When the second end of the conductive strip collides with the second metallic element, a click sound is generated. Consequently, the user can feel the depressing feedback. As previously described, the conventional mechanical key structure is equipped with the push element and the linkage element as the triggering structure. Since the key structure of the present invention is not equipped with the push element and the linkage element, the key structure of the present invention has reduced thickness. In other words, the key structure of the present invention can solve the drawbacks of the conventional technologies.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure.

Figure 1:
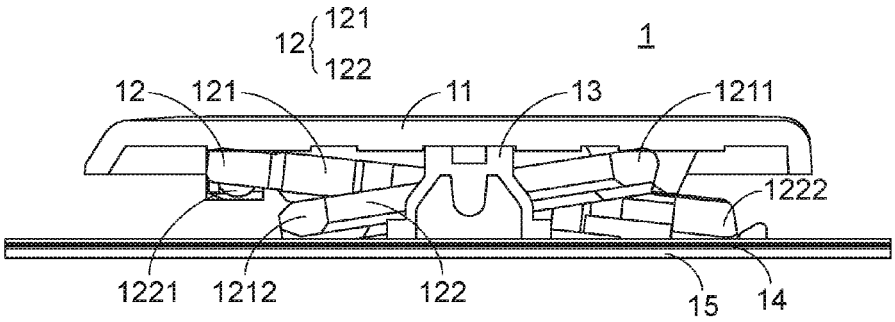
FIG.1 PRIOR ART
FIG. 1 is a schematic side cross-sectional view illustrating a conventional key structure.
Figure 2:
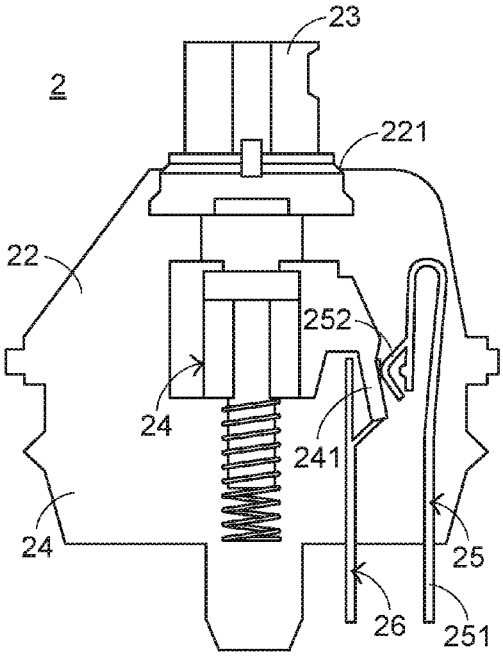
FIG.2 PRIOR ART
FIG. 2 is a schematic exploded view illustrating a conventional mechanical key structure.
Figure 3:
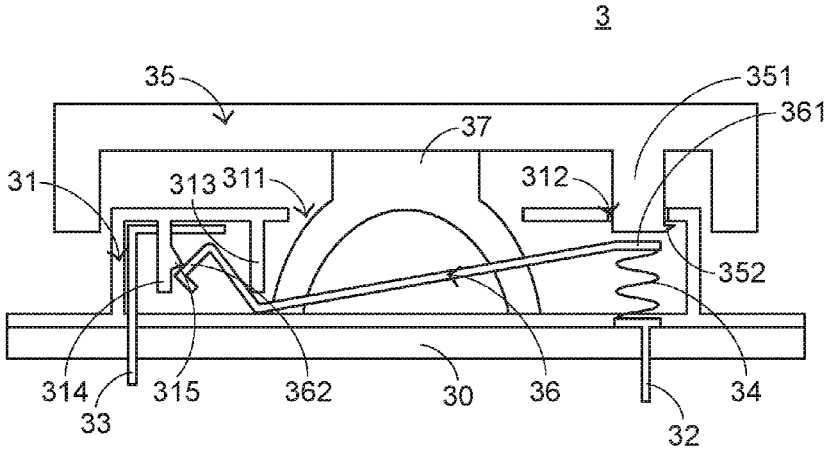
FIG. 3 is a schematic side cross-sectional view illustrating a key structure according to a first embodiment of the present invention.

FIG. 3 is a schematic side cross-sectional view illustrating a key structure according to a first embodiment of the present invention. As shown in FIG. 3, the key structure 3 comprises a circuit board 30, a housing 31, a first metallic element 32, a second metallic element 33, a metallic resilience element 34, a keycap 35, a conductive strip 36 and an elastic element 37. The housing 31 comprises a first opening 311, a second opening 312, a first extension wall 313, a second extension wall 314 and a stopping structure 315. The first metallic element 32 is located at a first side of the housing 31. Moreover, the first metallic element 32 is penetrated through a bottom side of the housing 31 and electrically connected with the circuit board 30. The second metallic element 33 is located at a second side of the housing 31. A first end of the second metallic element 33 is inserted into an inner space of the housing 31. Moreover, the second metallic element 33 is penetrated through the bottom side of the housing 31 and electrically connected with the circuit board 30. The metallic resilience element 34 is disposed within the housing 31 and connected with the first metallic element 32. In an embodiment, the circuit board 30 is a printed circuit board (PCB), and the metallic resilience element 34 is a metallic spring. Moreover, the first metallic element 32 and the second metallic element 33 are penetrated through the circuit board 30 and electrically connected with the circuit board 30.

As shown in FIG. 3, the keycap 35 is disposed on the housing 31 and movable upwardly or downwardly relative to the housing 31. In an embodiment, the keycap 35 comprises a triggering part 351 and a fixing block 352. The triggering part 351 is protruded downwardly from an inner surface of the keycap 35. Moreover, the triggering part 351 is penetrated through the second opening 312 of the housing 31 and located over the metallic resilience element 34. The fixing block 352 is disposed on the triggering part 351. When the triggering part 351 is penetrated through the second opening 312 and the keycap 35 is not depressed, the fixing block 352 is contacted with the housing 351. Consequently, the triggering part 351 is not detached from the second opening 312. That is, the keycap 35 is fixed on the housing 31 through the fixing block 352. In an embodiment, the total width of the triggering part 351 and the fixing block 352 is larger than the width of the second opening 312. While the keycap 35 is assembled with the housing 31, the fixing block 352 is subjected to a tiny deformation in response to the material elasticity of the keycap 35. Consequently, the triggering part 351 and the fixing block 352 can be moved across the second opening 312. Moreover, the fixing block 352 is contacted with the housing 31, and thus the triggering part 351 is not detached from the second opening 312.

The conductive strip 36 is disposed within the housing 31. A first end 361 of the conductive strip 36 is arranged between the triggering part 351 and the metallic resilience element 34. While the first end 361 of the conductive strip 36 is pressed by the triggering part 351, the conductive strip 36 is swung relative to the housing 31. Consequently, a second end 362 of the conductive strip 36 is moved across the stopping structure 315. After the second end 362 of the conductive strip 36 is moved across the stopping structure 315, the second end 362 of the conductive strip 36 collides with the second metallic element 33 and thus a click sound is generated.

In an embodiment, the second end 362 of the conductive strip 36 has a bent structure and is close to the stopping structure 315. While the second end 362 of the conductive strip 36 is contacted with the stopping structure 315 and moved across the stopping structure 315, the acceleration of the swung conductive strip 36 is increased. Due to the collision, the force of the second end 362 of the conductive strip 36 acting on the second metallic element 33 is increased. Consequently, the key structure 3 can provide the click sound with higher sound volume. In an embodiment, the conductive strip 36 is made of a metallic material, and thus the conductive strip 36 is electrically conductive. Since the first end 361 of the conductive strip 36 is connected with (e.g., welded on) the metallic resilience element 34, the conductive strip 36 is fixed in the housing 31. Consequently, the first end 361 of the conductive strip 36 is arranged between the triggering part 351 and the metallic resilience element 34.

The structure of the housing 31 will be described in more details as follows. The first opening 311 is formed in a top surface of the housing 31. The second opening 312 is also formed in the top surface of the housing 31. Moreover, the second opening 312 is located beside the first opening 311. The triggering part 351 is penetrated through the second opening 312. The first extension wall 313 is protruded from the housing 31 to the inner portion of the housing 31. Moreover, the first extension wall 313 is located near the first opening 311. While the conductive strip 36 is swung, the first extension wall 313 is contacted with the conductive strip 36. With the assistance of the first extension wall 313, the second end 362 of the conductive strip 36 is swung in the direction toward the stopping structure 315. The second extension wall 314 is protruded from the housing 31 to the inner portion of the housing 31. Moreover, the second extension wall 314 is located near the second side of the housing 31. The stopping structure 315 is disposed on the second extension wall 314. The elastic element 37 is disposed within the housing 31, partially penetrated through the first opening 311, and contacted with the inner surface of the keycap 35. The elastic element 37 provides an elastic force to the keycap 35. The keycap 35 is movable upwardly relative to the housing 31 in response to the elastic force. In an embodiment, the elastic element 37 is a plastic elastomer. The first extension wall 313, the second extension wall 314 and the stopping structure 315 are made of a plastic material, and integrally formed with the housing 31.

Figure 4:
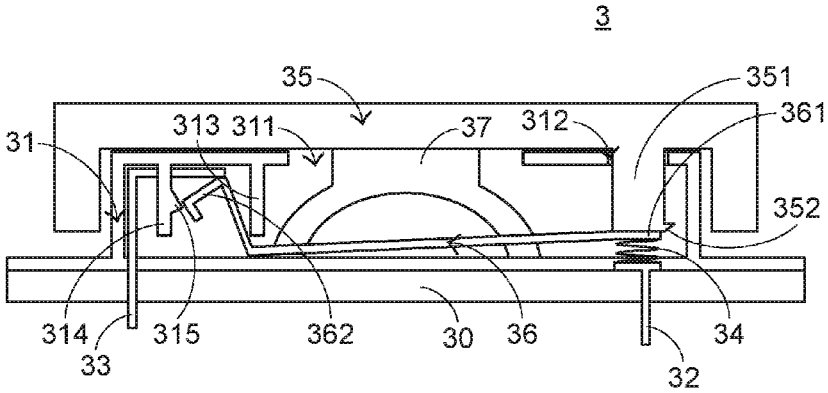
FIG. 4 is a schematic side cross-sectional view illustrating the key structure according to the first embodiment of the present invention, in which the keycap is depressed.

The operations of the key structure 3 in response to the depressing action of the user will be illustrated as follows. Please refer to FIGS. 3 and 4. FIG. 4 is a schematic side cross-sectional view illustrating the key structure according to the first embodiment of the present invention, in which the keycap is depressed. While the keycap 35 is depressed, the keycap 35 is moved downwardly to push the elastic element 37 in response to the depressing force. As the elastic element 37 is pushed by the keycap 35, the elastic element 37 is subjected to deformation. Moreover, while the keycap 35 is moved downwardly, the triggering part 351 is correspondingly moved downwardly to push the first end 361 of the conductive strip 36. Since the metallic resilience element 34 is pushed by the first end 361 of the conductive strip 36, the metallic resilience element 34 is in a compressed state. Moreover, since the first end 361 of the conductive strip 36 is descended, the second end 362 of the conductive strip 36 is ascended. That is, the conductive strip 36 is swung relative to the housing 31. While the conductive strip 36 is swung, a portion of the conductive strip 36 that is close to the second end 362 of the conductive strip 36 is contacted with the first extension wall 313. Consequently, the second end 362 of the conductive strip 36. With the assistance of the first extension wall 313, the second end 362 of the conductive strip 36 is swung in the direction toward the stopping structure 315 (e.g., in the clockwise direction as shown in FIG. 4).

Since the second end 362 of the conductive strip 36 is swung at a fast speed, the collision force between the second end 362 of the conductive strip 36 and the stopping structure 315 is sufficiently high. Consequently, the second end 362 of the conductive strip 36 can be moved across the stopping structure 315. Due to the friction force between the second end 362 of the conductive strip 36 and the stopping structure 315, the acceleration of the swung conductive strip 36 is increased. That is, the force of swinging the second end 362 of the conductive strip 36 is increased. Consequently, when the second end 362 of the conductive strip 36 collides with the second metallic element 33, the sound volume of the click sound is increased. At the time when the second end 362 of the conductive strip 36 collides with the second metallic element 33, the first metallic element 32 is electrically connected with the second metallic element 33 through the metallic resilience element 34 and the conductive strip 36. Consequently, the key structure 3 generates a key signal.

When the keycap 35 is no longer depressed by the user, no external force is applied to the keycap 35. In response to the elasticity of the elastic element 37, the compressed elastic element 37 is restored to its original shape to provide an upward elastic restoring force to the keycap 35. In response to the upward elastic restoring force, the keycap 35 is returned to its original position where it is not depressed.

At the same time, the first end 361 of the conductive strip 36 is not pushed by the triggering part 351. In response to the elasticity of the metallic resilience element 34, the metallic resilience element 34 is restored to its original shape to provide an upward elastic force to the first end 361 of the conductive strip 36. Consequently, the conductive strip 36 is returned to its original position where it is not swung.

In accordance with a feature of the present invention, the key structure 3 generates the key signal when the electric connection between the first metallic element 32 and the second metallic element 33 is established. In other words, it is not necessary to install the key intersection on the circuit board 30 corresponding to the keycap 35. Moreover, the elastic element 37 is not equipped with the triggering structure to trigger the key intersection.

Figure 5:
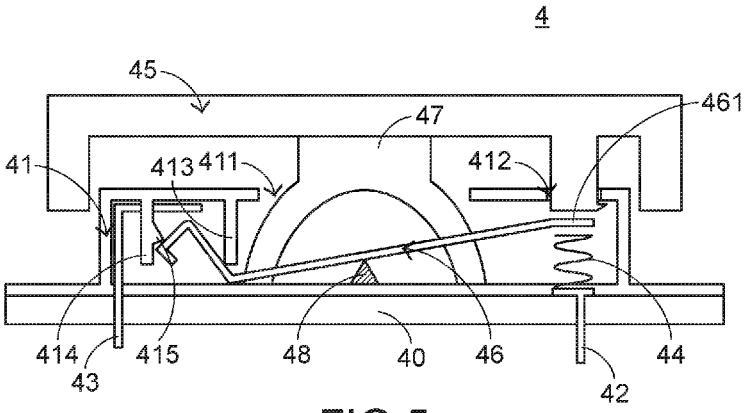
FIG. 5 is a schematic side cross-sectional view illustrating a key structure according to a second embodiment of the present invention.

The present invention further provides a second embodiment, which is distinguished from the first embodiment. FIG. 5 is a schematic side cross-sectional view illustrating a key structure according to a second embodiment of the present invention. As shown in FIG. 5, the key structure 4 comprises a circuit board 40, a housing 41, a first metallic element 42, a second metallic element 43, a metallic resilience element 44, a keycap 45, a conductive strip 46, an elastic element 47 and a supporting structure 48. The housing 41 comprises a first opening 411, a second opening 412, a first extension wall 413, a second extension wall 414 and a stopping structure 415. The structures and functions of the components of the key structure 4 which are identical to those of the first embodiment are not redundantly described herein. In comparison with the first embodiment, the key structure 4 of this embodiment further comprises the supporting structure 48.

As shown in FIG. 5, the supporting structure 48 is disposed within the housing 41 and contacted with the conductive strip 46. The supporting structure 48 is used for supporting the conductive strip 46. Consequently, the conductive strip 46 is fixed in the housing 41. Since the conductive strip 46 is fixed in the housing 41 through the supporting structure 48, the first end 461 of the conductive strip 46 may be selectively connected with the metallic resilience element 44 or not connected with the metallic resilience element 44 according to the practical requirements. Regardless of whether the first end 461 of the conductive strip 46 is connected with the metallic resilience element 44, the key structure 4 can be normally operated. While the keycap 45 is depressed, the keycap 45 is moved downwardly relative to the housing 41 in response to the depressing force. The operations of the other components are similar to those of the above embodiment, and are not redundantly described herein. As mentioned above, the conductive strip 46 is fixed in the housing 41 through the supporting structure 48. Consequently, the conductive strip 46 is swung relative to the housing 41 by using the supporting structure 48 as a fulcrum. Under this circumstance, the conductive strip 46 is swung more smoothly. The operations of depressing the keycap 45 are similar to those of the above embodiment, and are not redundantly described herein.

In this embodiment, the key structure 4 employs two conductive paths. Firstly, like the above embodiment, the first metallic element 42 is electrically connected with the second metallic element 43 through the metallic resilience element 44 and the conductive strip 46. Secondly, the first metallic element 42 is electrically connected with the supporting structure 48 through the metallic resilience element 44 and the conductive strip 46. In this embodiment, the supporting structure 48 is made of a metallic material. Moreover, the supporting structure 48 is penetrated through the bottom side of the housing 41 and electrically connected with the circuit board 40. Consequently, the supporting structure 48 is electrically conductive. In the second conductive path, the second metallic element 43 does not need to be electrically connected with the circuit board 40.

Figure 6:
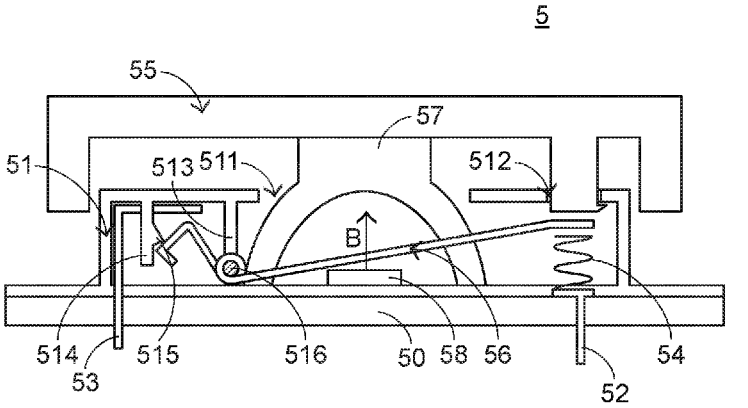
FIG. 6 is a schematic side cross-sectional view illustrating a key structure according to a third embodiment of the present invention.

The present invention further provides a third embodiment, which is distinguished from the above embodiments. FIG. 6 is a schematic side cross-sectional view illustrating a key structure according to a third embodiment of the present invention. As shown in FIG. 6, the key structure 5 comprises a circuit board 50, a housing 51, a first metallic element 52, a second metallic element 53, a metallic resilience element 54, a keycap 55, a conductive strip 56, an elastic element 57 and a light-emitting element 58. The housing 51 comprises a first opening 511, a second opening 512, a first extension wall 513, a second extension wall 514, a stopping structure 515 and a rotating shaft 516. The structures and functions of the components of the key structure 5 which are identical to those of the above embodiments are not redundantly described herein. In comparison with the above embodiments, the following two aspects are distinguished. Firstly, the housing 51 further comprises the rotating shaft 516. Secondly, the key structure 5 further comprises the light-emitting element 58.

As shown in FIG. 6, the rotating shaft 516 is disposed on the first extension wall 513. A portion of the conductive strip 56 that is close to the second end of the conductive strip 56 is sheathed around the rotating shaft 516. Consequently, the conductive strip 56 is fixed in the housing 51. In this embodiment, the conductive strip 56 is swung relative to the housing 51 by using the rotating shaft 516 as the pivotal center. With the assistance of the rotating shaft 516, the conductive strip 56 is swung more smoothly.

The light-emitting element 58 is disposed within the housing 51 and electrically connected with the circuit board 50. The light-emitting element 58 emits a light beam B. The light beam B is projected to the keycap 55. In this embodiment, the keycap 55 can be illuminated. Preferably, the light-emitting element 58 is a top-view light emitting diode.

From the above descriptions, the present invention provides the key structure. The circuit board for the key structure is not equipped with the key intersection. That is, the circuit board is not the membrane switch circuit board. Moreover, the first metallic element and the second metallic element are electrically connected with the circuit board. The housing is located over the circuit board. The elastic element is disposed within the housing. Consequently, the keycap is located over the housing. The metallic resilience element is disposed within the housing. When the keycap is depressed, the triggering part of the keycap is moved downwardly to push the first end of the conductive strip. Consequently, the conductive strip is swung relative to the housing, and the second end of the conductive strip collides with the second metallic element. Under this circumstance, the electric connection between the first metallic element and the second metallic element is established. When the second end of the conductive strip collides with the second metallic element, a click sound is generated. Consequently, the user can feel the depressing feedback. As previously described, the conventional mechanical key structure is equipped with the push element and the linkage element as the triggering structure. Since the key structure of the present invention is not equipped with the push element and the linkage element, the key structure of the present invention has reduced thickness. In other words, the key structure of the present invention can solve the drawbacks of the conventional technologies.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a circuit board;

a housing disposed on the circuit board, and comprising a stopping structure;

a first metallic element located at a first side of the housing, wherein the first metallic element is penetrated through a bottom side of the housing and electrically connected with the circuit board;

a second metallic element located at a second side of the housing, wherein a first end of the second metallic element is inserted into an inner portion of the housing;

a metallic resilience element disposed within the housing and connected with the first metallic element;

a keycap disposed over the housing and movable relative to the housing, wherein the keycap comprises a triggering part, and the triggering part is inserted into the inner portion of the housing and located over the metallic resilience element; and a conductive strip disposed within the housing, wherein a first end of the conductive strip is arranged between the triggering part of the keycap and the metallic resilience element, wherein while the first end of the conductive strip is pressed by the triggering part, the conductive strip is swung relative to the housing and a second end of the conductive strip is moved across the stopping structure to collide with the second metallic element, so that a sound is generated, wherein the second end of the conductive strip has a bent structure close to the stopping structure, and an acceleration of the swung conductive strip is increased while the second end of the conductive strip is moved across the stopping structure.

2. The key structure according to claim 1, wherein the first end of the conductive strip is connected with the metallic resilience element, so that the conductive strip is fixed in the housing.

3. The key structure according to claim 1, wherein the housing further comprises:

a first opening formed in a top surface of the housing;

a second opening formed in the top surface of the housing, wherein the triggering part is partially penetrated through the second opening;

a first extension wall protruded from the housing to the inner portion of the housing, and located near the first opening, wherein while the conductive strip is swung, the first extension wall is contacted with the conductive strip to facilitate the second end of the conductive strip to be swung toward the stopping structure; and a second extension wall protruded from the housing to the inner portion of the housing, and located near the second side of the housing, wherein the stopping structure is disposed on the second extension wall.

4. The key structure according to claim 3, wherein the first extension wall, the second extension wall and the stopping structure are integrally formed with the housing.

5. The key structure according to claim 3, further comprising an elastic element, which is disposed within the housing, penetrated through the first opening, and contacted with the keycap, wherein the elastic element provides an elastic force to the keycap, and the keycap is movable relative to the housing in response to the elastic force, wherein when the keycap is depressed and moved relative to the housing, the elastic element is pushed by the keycap and subjected to a deformation, wherein when the keycap is not depressed, the elastic element is restored from the deformation, and the keycap is returned to an original position in response to the elastic force.

6. The key structure according to claim 3, wherein the keycap further comprises a fixing block, wherein the fixing block is disposed on the triggering part and contacted with the housing, so that the triggering part is not detached from the second opening.

7. The key structure according to claim 3, wherein a second end of the second metallic element is penetrated through the bottom side of the housing and electrically connected with the circuit board, wherein when the second end of the conductive strip collides with the second metallic element, the first metallic element is electrically connected with the second metallic element through the metallic resilience element and the conductive strip, so that a key signal is generated.

8. The key structure according to claim 3, wherein the housing further comprises a rotating shaft, and the rotating shaft is disposed on the first extension wall, wherein a portion of the conductive strip is sheathed around the rotating shaft, so that the conductive strip is fixed in the housing.

9. The key structure according to claim 1, wherein the key structure further comprises a supporting structure, and the supporting structure is disposed within the housing and contacted with the conductive strip, wherein the conductive strip is supported by the supporting structure, so that the conductive strip is fixed in the housing.

10. The key structure according to claim 9, wherein the supporting structure is penetrated through the bottom side of the housing and electrically connected with the circuit board, wherein when the first end of the conductive strip is pressed by the triggering part and the first end of the conductive strip is contacted with the metallic resilience element, the first metallic element is electrically connected with the supporting structure through the metallic resilience element and the conductive strip, so that a key signal is generated.

* * * * *